US010916149B2

(12) United States Patent
Eichler et al.

(10) Patent No.: US 10,916,149 B2
(45) Date of Patent: Feb. 9, 2021

(54) METHOD AND SYSTEM FOR OPTIMIZATION OF AIRCRAFT OPERATIONS USING UPLINK WEATHER DATA

(71) Applicant: HONEYWELL INTERNATIONAL INC., Morris Plains, NJ (US)

(72) Inventors: Zdenek Eichler, Olomouc (CZ); Robert Sosovicka, Brno (CZ); Jiri Svoboda, Okr. Novy Jicin (CZ); Helena Trefilova, Brno (CZ); Tomas Bouda, Brno (CZ)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 285 days.

(21) Appl. No.: 15/907,776

(22) Filed: Feb. 28, 2018

(65) Prior Publication Data

US 2019/0266900 A1 Aug. 29, 2019

(51) Int. Cl.
*G08G 5/00* (2006.01)

(52) U.S. Cl.
CPC ..... *G08G 5/0047* (2013.01); *G08G 5/003* (2013.01); *G08G 5/0013* (2013.01); *G08G 5/0021* (2013.01); *G08G 5/0091* (2013.01)

(58) Field of Classification Search
None
See application file for complete search history.

(56) References Cited

U.S. PATENT DOCUMENTS 8,862,287 B1 * 10/2014 Clark ..... G01C 23/00 701/3
8,983,760 B2 3/2015 McDonald
9,199,724 B2 12/2015 Pastor
9,313,276 B2 4/2016 Pereira
2008/0195264 A1 * 8/2008 Deker ..... G05D 1/0204 701/7

(Continued)

FOREIGN PATENT DOCUMENTS

EP 2778618 A2 9/2014

OTHER PUBLICATIONS

Priess, S., et al.; Analysis of the Use of Estimated Time of Arrival Broadcast for Interval Management; Air Traffic Management Research and Development Seminar; Jun. 27, 2017.

(Continued)

*Primary Examiner* — Kelly D Williams
(74) *Attorney, Agent, or Firm* — Lorenz & Kopf, LLP

(57) ABSTRACT

Methods and systems are provided for optimizing aircraft operations using uplink weather data to identify predicted turbulent conditions. The method comprises uploading current weather data to a flight management system (FMS) of an aircraft. Areas of turbulence are identified according to the uploaded weather data including areas of turbulence along the client flight trajectory stored in the FMS of the aircraft. An optimal turbulence penetration speed is planned for each identified area of turbulence. The estimated time of arrival (ETA) and minimum and maximum estimate time of arrival (ETA min/max) for the aircraft is recalculated based on the optimal turbulence penetration speeds. The recalculated ETA and ETA min/max is automatically transmitted to an air traffic control (ATC) authority with the FMS of the aircraft.

17 Claims, 4 Drawing Sheets

(56) References Cited

U.S. PATENT DOCUMENTS

2016/0232796 A1 8/2016 Oldach

OTHER PUBLICATIONS

Mutual, L., et al; Initial 4D Trajectory Management Concept Evaluation; Tenth USA/Europe Air Traffic Management Research and Development Seminar (ATM2013).

Transportation Safety Board of Canada, Aviation Investigation Report A15F0165 Severe Turbulence Encounter, Feb. 20, 2017, Retrieved from the Internet: URL: https://www.skybrary.aero/bookshelf/books/4196.pdf.

* cited by examiner

METHOD AND SYSTEM FOR OPTIMIZATION OF AIRCRAFT OPERATIONS USING UPLINK WEATHER DATA

TECHNICAL FIELD

The present invention generally relates to aircraft operations, and more particularly relates to optimization of aircraft operations using uplink weather data.

BACKGROUND

Coordination of arrival times for in-flight aircraft traffic is important to efficient air operations. Ensuring properly sequenced arrivals of in-flight aircraft at planned intervals is a key component of these operations. If aircraft are not properly staggered with their arrival times, aircraft congestion may be a result. Hence, there is a need for optimizing aircraft operations with efficient sequencing of arrival traffic by highly reliable time of arrival control functions that is accomplished by using weather data to identify predicted turbulent conditions and provide an appropriate speed profile that includes changes in the affected area.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

A method is provided for optimizing aircraft operations using uplink weather data to identify predicted turbulent conditions. The method comprises: uploading current weather data to a flight management system (FMS) of an aircraft; and in the FMS, identifying areas of turbulence according to the uploaded weather data, identifying the areas of turbulence along a current flight trajectory of the aircraft, the current flight trajectory stored in the FMS of the aircraft, planning an optimal turbulence penetration speed for each of the identified areas of turbulence, recalculating an estimated time of arrival (ETA) for the aircraft based on the optimal turbulence penetration speeds for the aircraft, and automatically transmitting the recalculated ETA to an air traffic control (ATC) authority.

A system is provided for optimizing aircraft operations using weather data to identify predicted turbulent conditions. The system comprises: a data source for current weather conditions including turbulence forecasts and observations; a flight management system (FMS) located on board an in-flight aircraft that uploads the current weather conditions from the data source via a communications data uplink, the FMS configured to, identify one or more areas of turbulence along a current flight trajectory for the aircraft, where the current flight trajectory is stored in the FMS, plan an optimal turbulence penetration speed of the aircraft for each area of turbulence, and recalculate the estimated time of arrival (ETA) to a designated waypoint along the current flight trajectory of the aircraft based on the optimal turbulence penetration speeds for the aircraft, and automatically transmit the recalculated ETAs; and a ground-based air traffic control (ATC) authority in communication with the FMS, the ATC authority configured to receive the automatically transmitted recalculated ETA automatically transmitted from the FMS of the aircraft.

Furthermore, other desirable features and characteristics of the methods and systems will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

A method and system for optimizing aircraft operations using weather data to identify predicted turbulent conditions and adjusting estimated time of arrival (ETA) for an aircraft has been developed. Current weather data is uploaded to a flight management system (FMS) located on board the aircraft. Areas of turbulence along the flight plan are identified according to the uploaded weather data. Areas of turbulence along the current flight trajectory that is stored in the FMS of the aircraft are of particular concern. An "optimal turbulence penetration speed" is planned for each of the identified areas of turbulence along the current flight trajectory. An optimal turbulence penetration speed is a designated airspeed for the aircraft that accomplishes certain objectives such as maintaining optimal passenger comfort while passing through the area of turbulence. Once the optimal turbulence penetration speed is determined, the ETA for the aircraft is recalculated based on this optimal speed. The recalculated ETA is then automatically transmitted to an air traffic control (ATC) authority by the FMS of the aircraft.

In typical operations, passenger comfort is a top priority. Most aircraft have a pre-defined optimal turbulence penetration speed at which maximum passenger comfort is achieved in a turbulence area. The pre-defined optimal turbulence penetration speed is typically provided by the manufacturer based on aircraft parameters and performance characteristics. The optimal turbulence penetration speed is typically lower than the maximum cruise speed. Additionally, there may be multiple optimal turbulence penetration speeds for an aircraft based on the severity of the turbulence. For example, severe turbulence may have a very low optimal penetration speed while moderate or light turbulence will have higher optimal penetration speeds.

Figure 1:
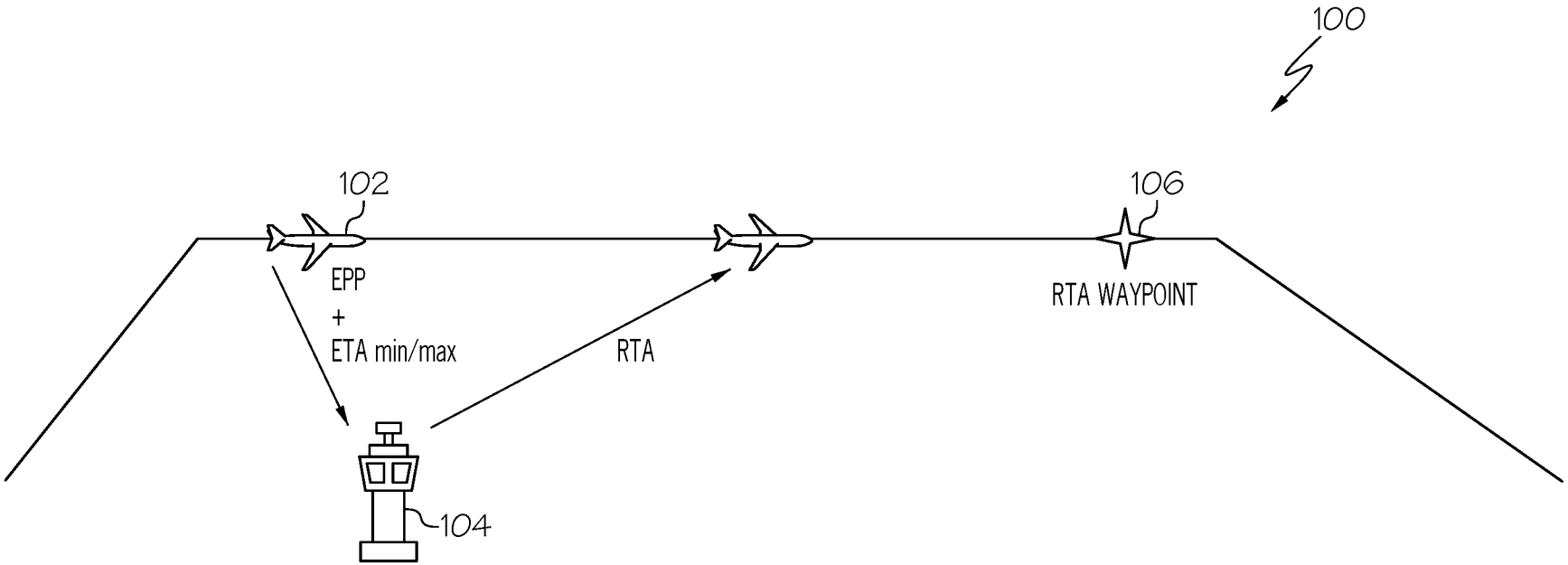
FIG. 1 shows a diagram of an example of a flight path for an aircraft in accordance with one embodiment.

Turning now to FIG. 1, a diagram 100 is shown of an example of a flight path for an aircraft in accordance with one embodiment. The in-flight aircraft 102 has an onboard FMS that generates an estimated path profile (EPP) that is a trajectory prediction to a waypoint 106 along the plan flight path. The FMS also generates a minimum and maximum (min/max) ETA. Both the EPP and the ETA min/max are transmitted to the ground-based ATC authority 104. Upon receipt of the EPP and ETA min/max, the ATC issues a required time of arrival (RTA) clearance for the waypoint 106. The aircraft 102 receives the clearance and adapts its airspeed during the flight in order to meet the RTA constraint. The RTA is used by ATC for management and sequencing of arriving aircraft along waypoints and in airports. In some embodiments, the FMS of an aircraft computes the ETA max/max based on the aircraft min/max operational airspeed needed to meet the RTA requirement. In some embodiments, a pilot preferred speed may be manually entered into the FMS by the pilot to override the automatic computation of an airspeed by the FMS.

During normal operations, the ATC requests an ETA min/max interval for selected waypoints from the aircraft. The ETA min/max is calculated and provided by the FMS to the ATC. Upon receipt, the ATC provides an RTA clearance to the aircraft. The aircraft airspeed is adapted automatically by the FMS based on the RTA, ambient weather conditions, etc. This airspeed may be significantly different from the optimal turbulence penetration speed. Consequently, an airspeed reduction to an optimal turbulence penetration speed may require a recalculation of the ETA.

The optimal goal is to provide an accurate, up-to-date, recalculated ETA to the ATC from the aircraft for all waypoints along the flight path. With an accurate ETA, the ATC can issue and transmit an updated RTA to the aircraft based on the change in speed while passing through the area of turbulence. This provides the ATC with the most up-to-date and accurate information regarding the aircraft's arrival at the waypoint. With this information, the ATC is better able to manage air traffic flow and sequencing to avoid congestion and optimize operations.

Figure 2A:
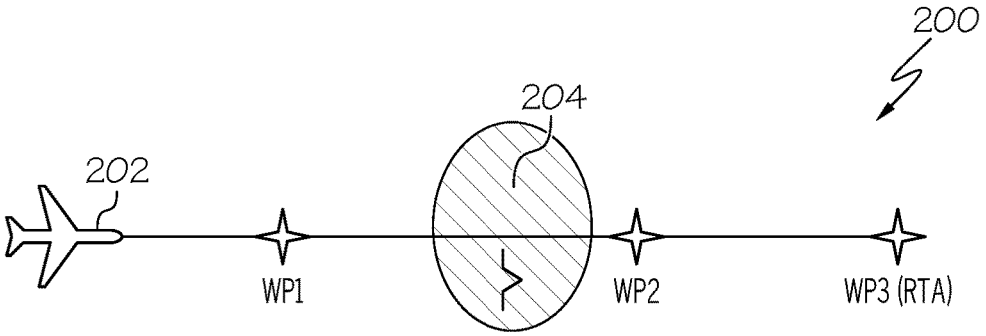
FIG. 2A shows a diagram of an example of a flight path for an aircraft with an area of turbulence along the flight path in accordance with one embodiment.
Figure 2B:
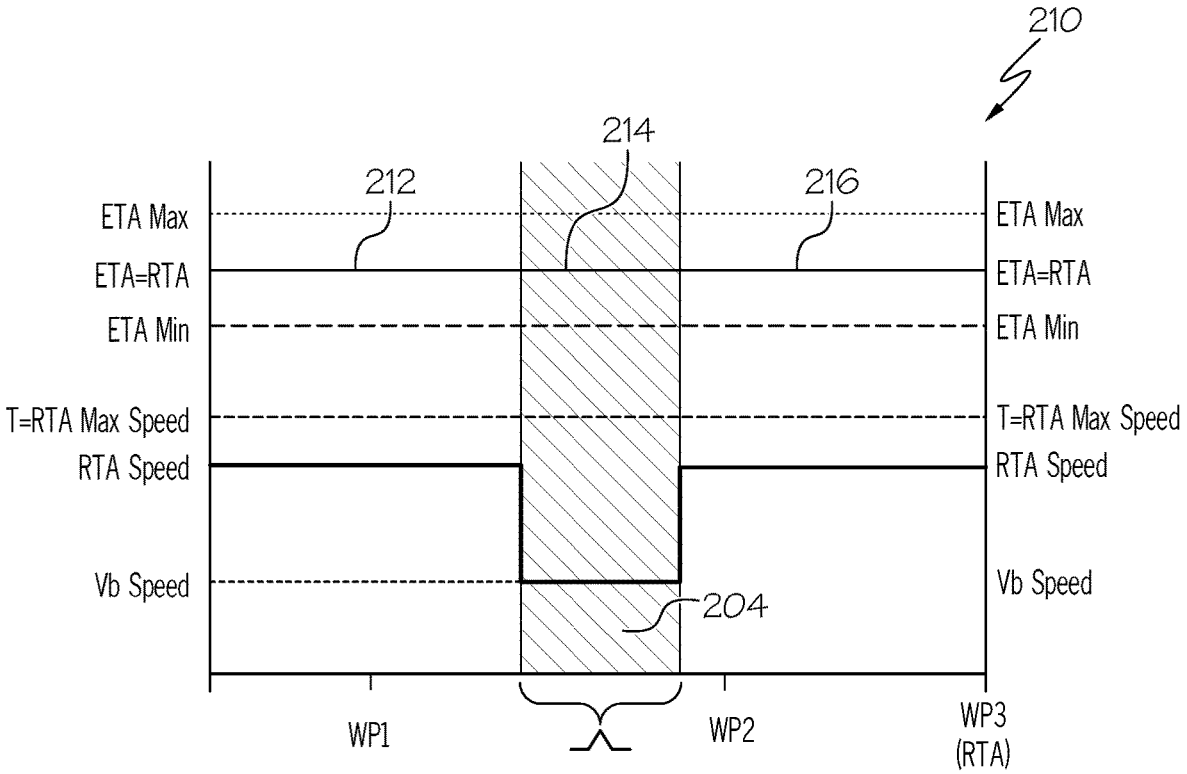
FIG. 2B shows a graph of the required time of arrival (RTA) speeds in comparison with a graph of the estimated time of arrival (ETA) for an aircraft flying along the flight path shown in FIG. 2A in accordance with one embodiment.

Turning now to FIG. 2A, a diagram 200 is shown of a flight path for an aircraft with an area of turbulence along the flight path in accordance with one embodiment. In this example, the aircraft 202 is traveling along the flight path towards three sequential waypoints (WP1, WP2 and WP3). The FMS of the aircraft 202 has identified an area of turbulence 204 along the flight path between WP1 and WP2. Turning now to FIG. 2B, a graph 210 is shown of the RTA speeds in comparison with a graph of the ETA for the aircraft flying along the flight path shown in FIG. 2A in accordance with one embodiment. In this example, the graph 210 shows three distinct time periods: prior to entering the area of turbulence 212; during the area of turbulence 214; and subsequent exiting the area of turbulence 216. In each time period, the graph shows the ETA maximum and the ETA minimum along with the present ETA calculation for the aircraft. Also shown are the RTA maximum speed and the RTA actual speed of the aircraft that are necessary to meet the RTA constraint at WP3.

As the aircraft 202 approaches the area of turbulence 204, the RTA speed is reduced to an optimal turbulence penetration speed (Vb speed) as calculated by the FMS on board the aircraft 202. As the airspeed is reduced in the turbulent area 204, the ETA is recalculated and transmitted to the ATC authority. Upon exiting the area of turbulence 204, the airspeed is returned to the normal RTA speed (not limited by Vb). During the changes of speed to the aircraft, the ETA is recalculated with each change. The recalculated ETA is automatically transmitted to the ATC, which in turn provides an updated RTA to the aircraft. The net effect is maintaining an updated RTA while also maintaining an accurate ETA that falls within the ETA min/max parameters for the aircraft. As previously described, the goal is to maintain an accurate ETA and ETA min/max that is provided to the ATC. The ATC then issues an updated RTA to the aircraft which corresponds to the recalculated ETA. The optimum result is that the ETA and the RTA are equivalent in value which provides an accurate status of the aircraft along its flight plan as well as accurate time constraints for its arrival at a waypoint.

Figure 3:
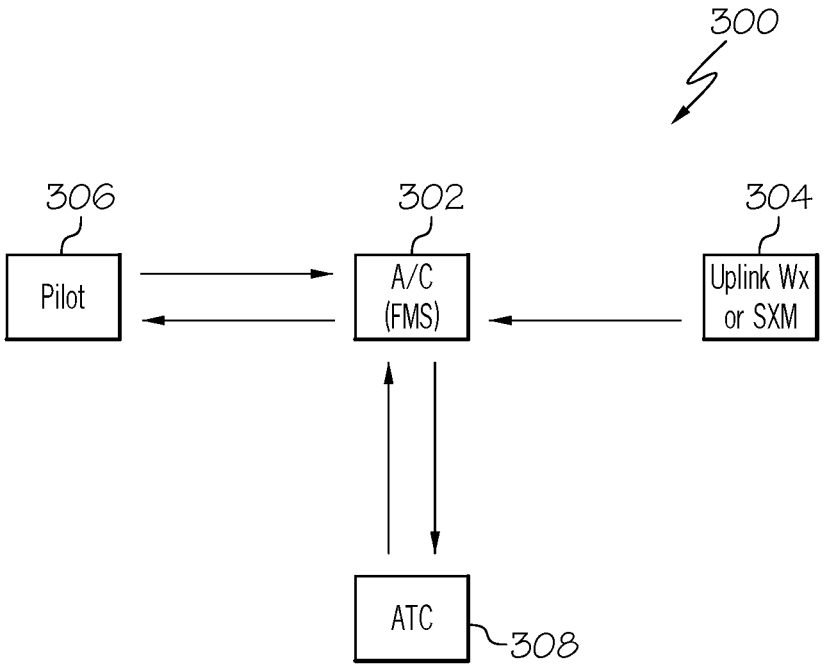
FIG.3 shows a block diagram of a system to optimize aircraft operations using uplink weather data in accordance with one embodiment.

Turning now to FIG. 3, a block diagram 300 is shown of a system to optimize aircraft operations using weather data in accordance with one embodiment. The system includes an FMS 302 located onboard an in-flight aircraft. The FMS 302 receives current weather that includes turbulence forecasts and current conditions from a data source 304 via a communications data uplink (Wx) from a ground based data source or alternatively from a satellite data link (SXM). The FMS 302 identifies areas of turbulence along the current flight trajectory for the aircraft. The flight trajectory is determined by retrieving a flight plan that is stored in the FMS 302. The FMS 302 plans an optimal turbulence penetration speed of the aircraft for each identified area of turbulence along the flight path. An updated ETA to a designated waypoint along the current flight trajectory is recalculated based on the optimal turbulence penetration speed. The updated ETA is automatically transmitted by the FMS 302 to a ground-based ATC 308. The ATC 308 issues an updated RTA based on the recalculated ETA and transmits that to the FMS 302. The FMS 302 then notifies the pilot of the aircraft 306 of the revised RTA. The pilot 306 will then confirm the revised RTA to the FMS 302.

In alternative embodiments, the pilot of the aircraft may designate different cruising "modes" to the FMS. These modes are used to determine the optimal turbulence penetration speed used by the aircraft. In some embodiments, the pilot may select a cruise mode of "comfort" that provides maximum passenger comfort. In a comfort mode the optimal turbulence penetration speed is used in all turbulence areas to calculate the ETA that is provided to the ATC. In other embodiments, the pilot may select a cruise mode of "fastest" that provides maximum transit airspeed through the area of turbulence while sacrificing some degree of passenger comfort. While utilizing the fastest mode in areas of light turbulence, the aircraft will maintain airspeed between its original ETA min/max parameters. In areas of moderate turbulence, the aircraft turbulence penetration speed will be reduced to predefined buffer (e.g., 30 knots). While in areas of severe turbulence, the aircraft will utilize the optimal turbulence penetration speed. As shown, the use of the fastest mode requires an accurate categorization of the intensity of the turbulence areas of light, moderate and severe. If such a categorization is not available from the data source of the weather conditions, the aircraft will default to using an optimal turbulence penetration speed.

Figure 4:
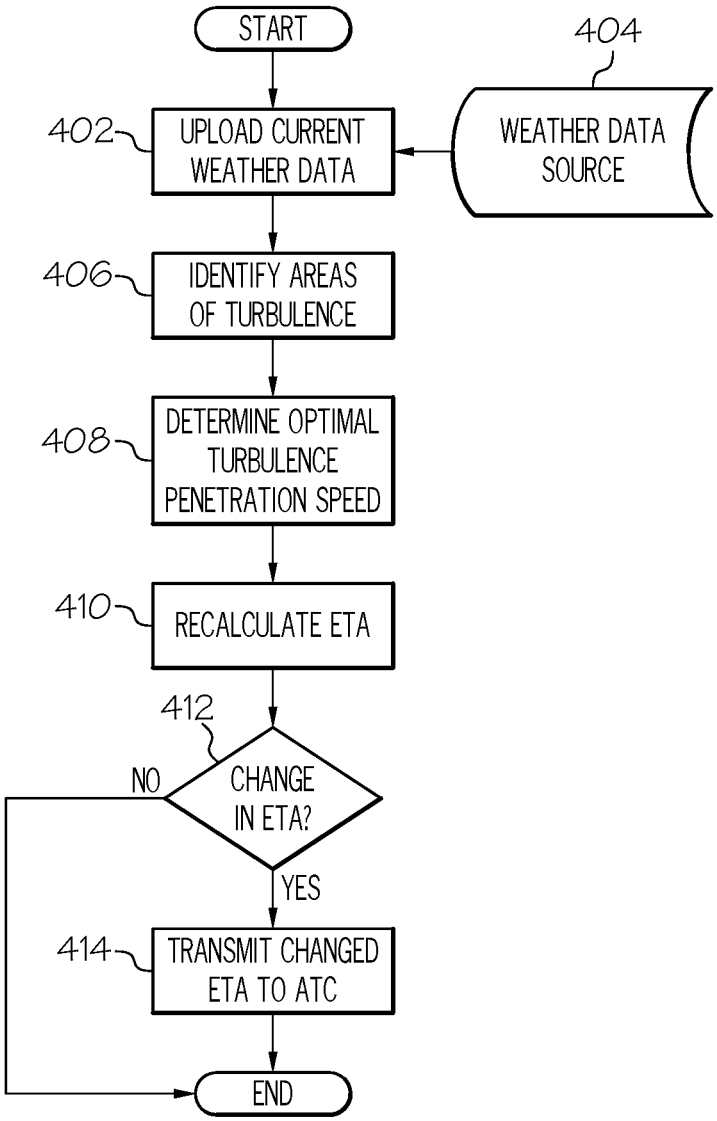
FIG. 4. shows a flowchart of a method to optimize aircraft operations using uplink weather data in accordance with one embodiment.

Turning now to FIG. 4, a flowchart 400 is shown of a method to optimize aircraft operations using weather data in accordance with one embodiment. First, current weather data is uploaded to an onboard FMS for an in-flight aircraft 402. The current weather data is provided by a weather data source via a communications data link 404. The weather data source may be a ground-based or a satellite communications system. The FMS uses the current weather data to identify areas of turbulence along the current flight trajectory 406. The current flight trajectory is determined by referencing a flight plan stored in the FMS. The FMS plans an optimal turbulence penetration speed for the aircraft for each identified area of turbulence 408. Upon entering the area of turbulence, the FMS recalculates the ETA for the aircraft based on the optimal turbulence penetration speed 410. If the optimal turbulence penetration speed results in a change in the ETA of the aircraft 412, the FMS will automatically transmit the recalculated ETA to an ATC authority 414. This provides the ATC with the most up-to-date and accurate status information regarding the aircraft. With this information, the ATC may then issue an updated RTA for the aircraft that is consistent with the recalculated ETA.

Those of skill in the art will appreciate that the various illustrative logical blocks, modules, circuits, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for optimizing aircraft operations using weather data to identify predicted turbulent conditions, comprising:

uploading current weather data to a flight management system (FMS) of an aircraft; and in the FMS, identifying areas of turbulence according to the uploaded weather data, identifying the areas of turbulence along a current flight trajectory of the aircraft, the current flight trajectory stored in the FMS of the aircraft, planning an optimal turbulence penetration speed for each of the identified areas of turbulence, where the optimal turbulence penetration speed for use by the aircraft is calculated based on a turbulence speed mode selected by a pilot of the aircraft for optimal speed of the aircraft through identified areas of severe turbulence, recalculating an estimated time of arrival (ETA) for the aircraft based on the optimal turbulence penetration speed for the aircraft, and automatically transmitting the recalculated ETA to an air traffic control (ATC) authority.

2. The method of claim 1, where the optimal turbulence penetration speed is specified by the manufacturer the aircraft based on performance characteristics.

3. The method of claim 1, where the optimal turbulence penetration speed is determined based on passenger comfort.

4. The method of claim 1, where the optimal turbulence penetration speed is determined based on optimal speed for the aircraft.

5. The method of claim 1, where the turbulence speed mode selected by the pilot of the aircraft is for optimal passenger comfort.

6. The method of claim 1, where the optimal speed for the aircraft through identified areas of flight turbulence uses normal speed of the aircraft.

7. The method of claim 1, where the optimal speed of the aircraft through identified areas of moderate turbulence uses the normal speed of the aircraft with a buffer to reduce the speed of the aircraft.

8. The method of claim 7, where the buffer to reduce the speed of the aircraft is 30 knots.

9. The method of claim 1, where the optimal turbulence penetration speed is confirmed by a pilot of the aircraft prior to entry in the identified areas of turbulence.

10. The method of claim 1, where the ETA is designated for specified waypoints along the current flight trajectory.

11. The method of claim 1, where the ETA is designated for the final destination of the current flight trajectory.

12. The method of claim 1, where the recalculated ETA is transmitted upon request from the ATC authority.

13. The method of claim 1, where the ETA is calculated within a minimum and maximum range.

14. A system for optimizing aircraft operations using weather data to identify predicted turbulent conditions, comprising:

a data source for current weather conditions including turbulence forecasts and observations;

a flight management system (FMS) located on board an in-flight aircraft that uploads the current weather conditions from the data source via a communications data uplink, the FMS configured to:

identify one or more areas of turbulence along a current flight trajectory for the aircraft, where the current flight trajectory is stored in the FMS, plan an optimal turbulence penetration speed of the aircraft for each area of turbulence, where the optimal turbulence penetration speed for use by the aircraft is calculated based on a turbulence speed mode selected by a pilot of the aircraft for optimal speed of the aircraft through identified areas of severe turbulence, and recalculate an estimated time of arrival (ETA) to a designated waypoint along the current flight trajectory of the aircraft based on the optimal turbulence penetration speeds for the aircraft, and automatically transmit the recalculated ETA; and a ground-based air traffic control (ATC) authority in communication with the FMS, the ATC authority configured to receive the automatically transmitted recalculated ETA from the FMS of the aircraft.

15. The system of claim 14, where the optimal turbulence penetration speed is planned based on passenger comfort.

16. The system of claim 14, where the optimal turbulence penetration speed is calculated based on a turbulence speed mode selected by a pilot of the aircraft.

17. The system of claim 14, where the optimal turbulence penetration speed is confirmed by a pilot of the aircraft prior to entry in the identified areas of turbulence.

* * * * *